US011284728B2

(12) United States Patent
McCauley et al.

(10) Patent No.: US 11,284,728 B2
(45) Date of Patent: Mar. 29, 2022

(54) MAT

(71) Applicants: James Peter McCauley, Mahahide (IE); Aileen Maria McCauley, Mahahide (IE)

(72) Inventors: James Peter McCauley, Mahahide (IE); Aileen Maria McCauley, Mahahide (IE)

( * ) Notice: Subject to any disclaimer, the term of this patent is extended or adjusted under 35 U.S.C. 154(b) by 507 days.

(21) Appl. No.: 16/322,697

(22) PCT Filed: Aug. 2, 2017

(86) PCT No.: PCT/IE2017/000014
§ 371 (c)(1),
(2) Date: Feb. 1, 2019

(87) PCT Pub. No.: WO2018/025252
PCT Pub. Date: Feb. 8, 2018

(65) Prior Publication Data

US 2021/0353074 A1 Nov. 18, 2021

(30) Foreign Application Priority Data

Aug. 4, 2016 (IE) ..... S2016/0206

(51) Int. Cl.
*A47D 5/00* (2006.01)
*A47D 15/00* (2006.01)

(52) U.S. Cl.
CPC ..... *A47D 5/006* (2013.01); *A47D 5/00* (2013.01); *A47D 15/003* (2013.01); *A47D 15/008* (2013.01)

(58) Field of Classification Search
CPC .... A47D 5/006; A47D 15/003; A47D 15/008; A47D 5/00
See application file for complete search history.

(56) References Cited

U.S. PATENT DOCUMENTS

| | | | | |
|---|---|---|---|---|
| 2,758,595 | A | 8/1956 | Lovett | |
| 2004/0195880 | A1* | 10/2004 | Gardner | A47D 15/003 297/250.1 |
| 2006/0105137 | A1* | 5/2006 | Kouts | A45C 7/0095 428/99 |
| 2013/0191999 | A1* | 8/2013 | Burrell | H04L 1/0071 5/655 |

OTHER PUBLICATIONS

International Search Report and Written Opinion for corresponding Application No. PCT/IE2017/000014 (13 pages).

* cited by examiner

*Primary Examiner* — David R Hare
*Assistant Examiner* — Madison Emanski
(74) *Attorney, Agent, or Firm* — Brett A. Schenck

(57) ABSTRACT

A non-rigid, soft, portable and foldable baby changing mat (1) having a restraint system (18) for restraining movement of a baby (46) during nappy changing or dressing in which the restraint system (18) comprises a knee controllable restraint system (18).

24 Claims, 16 Drawing Sheets

MAT

CROSS-REFERENCE TO RELATED APPLICATIONS

This application is the U.S. national phase entry under 35 U.S.C. § 371 of International Application No. PCT/IE2017/000014, filed on Aug. 2, 2017, which claims priority to Ireland Patent Application No. S2016/0206, filed on Aug. 4, 2016.

INTRODUCTION

This invention relates to a changing/dressing mat hereinafter referred to as changing mat adapted to prevent movement of a baby or child when changing a nappy/diaper or when performing drying/dressing operations and the like.

BACKGROUND OF THE INVENTION

Stationary and portable changing mats are widely used for changing the nappies of babies and young children. Such mats are also used when performing drying and dressing operations and are hereinafter referred to collectively as baby changing mats.

As an infant develops the capacity to move, baby changing operations can become difficult, time-consuming and stressful for both the carer and baby as a wriggling/moving child must be restrained whilst simultaneously changing the nappy whether on a mat or not. However, in order to be performed with relative ease, nappy changing requires the use of two hands with the result that nappy changing can be challenging where a baby is highly mobile or wriggling and must be held in place with one hand. Similar problems can be encountered when drying or dressing a baby.

In order to address the aforementioned problems, it is known to use changing mats with raised edges and/or a belt or strap to restrain the child. Nevertheless, the known mats are still ineffective at successfully keeping a child place on the mats, particularly as the baby gets older. For example, UK Patent Specification No. 2,357,965 describes a baby changing mat fitted with shoulder and waist straps for anchoring a baby to the mat. However, despite the use of the straps, it has been found that the child can still move uncontrollably on the mat during baby changing operations while the mat has a bulky and rigid non-foldable base rendering the mat non-portable.

It is also known to use vest-like attachments on changing pads or tables for holding a child in place. However, vest-like attachments are only suitable for use on non-portable or stationary changing tables and pads.

SUMMARY OF THE INVENTION

According to the invention there is provided a baby changing mat comprising a restraint system for restraining movement of a baby wherein the restraint system comprises a knee controllable restraint system.

Preferably, the knee controllable restraint system comprises at least one strap reversibly secured to the mat. More preferably, the at least one strap comprises a cross-body strap. Most preferably, the knee controllable restraint system comprises a pair of cross-body straps.

Suitably, the pair of cross-body straps comprises a pair of overlapping cross-body straps for embracing a baby.

Advantageously, each cross-body strap comprises a torso band for covering a baby's torso and a knee controllable brace contiguous with the torso band.

Preferably, the knee controllable brace is at a substantially right angle to the torso band. More preferably, the knee controllable brace comprises a strap-like brace.

Suitably, the knee controllable brace comprises a kneepad.

Preferably, the baby changing mat comprises a baby headrest. More preferably, the baby changing mat comprises a headrest cover sheet at the headrest.

In a preferred embodiment of the invention, the baby changing mat comprises a portable baby changing mat.

Preferably, the portable baby changing mat is movable between a closed position and an open baby restraining operating position. More preferably, the baby changing mat is movable between the closed position and the open baby restraining operating position about fold lines defined in the baby changing mat.

Optimally, the baby changing mat is folded in the closed position.

Suitably, the baby changing mat comprises a pouch in the closed position.

Advantageously, the baby changing mat is movable between the closed position and an intermediate open infant changing operating position in which the restraint system is concealed on the mat.

Preferably, the restraint system is concealed by the headrest cover sheet in the intermediate open infant position.

Suitably, the baby changing mat is movable between the closed position and the intermediate open infant changing operating position about fold lines defined in the mat.

Optionally, the mat further comprises table mountings for attaching the changing mat to a changing table.

Preferably, the mat comprises a lower substantially square section and an upper substantially triangular section. More preferably, the upper substantially triangular section comprises a closing flap. Most preferably, the lower substantially square section comprises first and second side panels defined by respective first and second vertical folds either side of the lower square section.

In an alternative embodiment of the invention, the changing mat comprises a stationary changing mat.

In a preferred embodiment of the invention, the changing mat comprises a soft non-rigid changing mat.

Optionally, the changing mat comprises a towel.

The invention therefore provides a baby changing mat for use by a user to change or dress a baby/infant in which the mat has a restraint system for restraining movement of the baby in which the restraint system is a built-in restraint system which can be actuated, operated and controlled by the user's knee. The knee controlled restraint system of the changing mat of the invention gently and safely keeps a baby in place on the mat without the need for carers to use their hands, thereby freeing up both hands to change a nappy or dry/dress the baby. More particularly, the mat is adapted to be portable while the interconnected and co-operating cross-straps and kneepads of the restraint system gently hold babies in place, keeping a carer's hands free for fast and easy changing—the torso bands connected to the kneepads effectively counterbalance a baby's movement so that if the baby tries to roll to the left, the force on the right kneepad counteracts the movement and vice versa when rolling to the right. The restraint system of the changing mat facilitates a compact, foldable and portable changing mat—the mat does not have to be a fixed or stationary mat and does not require a bulky or rigid back/frame to keep a baby in place on the mat. Accordingly, the changing mat can be fully portable and suitable for use at home and when travelling. Naturally, if desired, the changing mat of the invention can be manufactured as a stationary or fixed changing mat fitted with the restraint system of the invention.

The use of a carer's knees to apply a brace-like restraining force in the restraint system of the changing mat is highly effective at keeping a baby in place on the changing mat when compared with the straps, weighted pillows and rigid devices of the prior art. Moreover, the bracing effect is independent of the material from which the mat is formed and does not require a rigid back resulting in a fully collapsible and portable changing mat as required.

The portable changing mat of the invention is adapted to transform by folding and unfolding between, firstly, a changing mat with the restraint system deployed in a restraining position for wriggling babies, secondly, a more standard style intermediate position with the restraint system concealed or folded away so it is suitable for changing nappies of non-moving infants and, thirdly, a folded and compact portable pouch. Accordingly, the changing mat is suitable for use with all babies/infants ranging from newborns to toilet-trained young children.

If desired, the changing mat can also be used as a towel or as an aid to assist in dressing a baby from the torso down.

BRIEF DESCRIPTION OF THE DRAWINGS

The invention will now be described by way of example only with reference to the accompanying drawings in which.

DETAILED DESCRIPTION OF THE DRAWINGS

Figure 1:
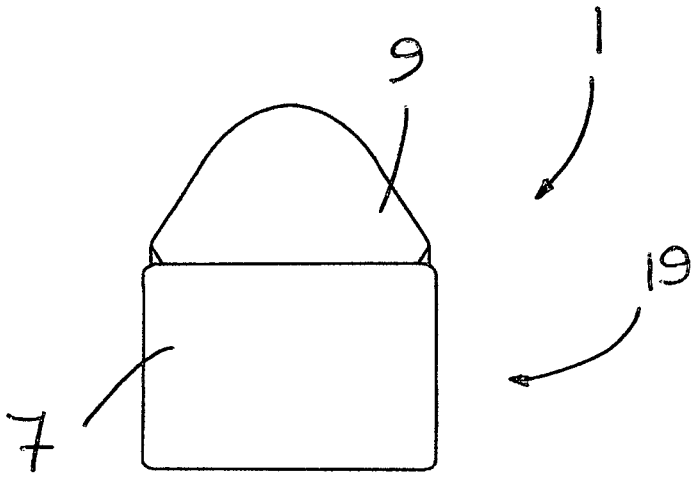
FIG. 1 is a plan view from above of an embodiment of the changing mat of the invention, for use by a user when changing or dressing a baby, in the form of a non-rigid, soft, portable and foldable changing mat in the portable closed or folded position (with the top flap in the open or unfolded position)
Figure 2:
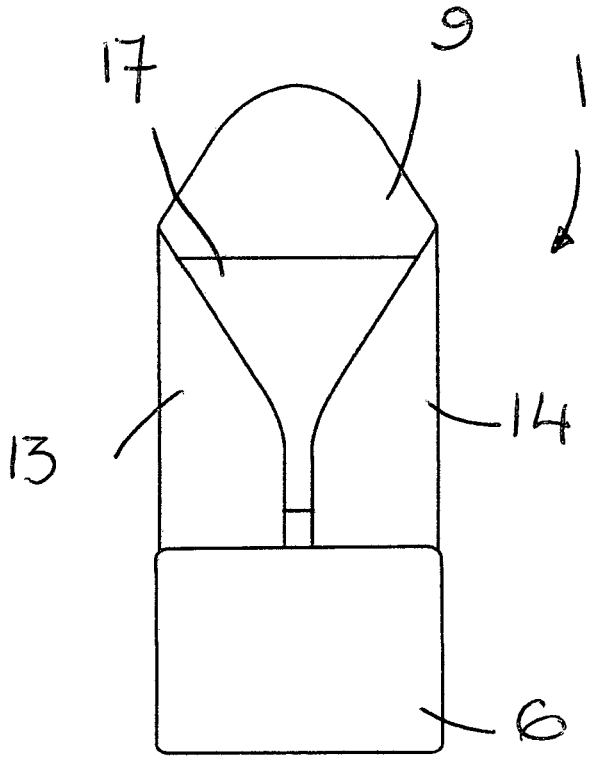
FIG. 2 is a plan view from above of the changing mat of FIG. 1 with the central and bottom panels/portions of the changing mat unfolded from the top panel/portion.
Figure 3:
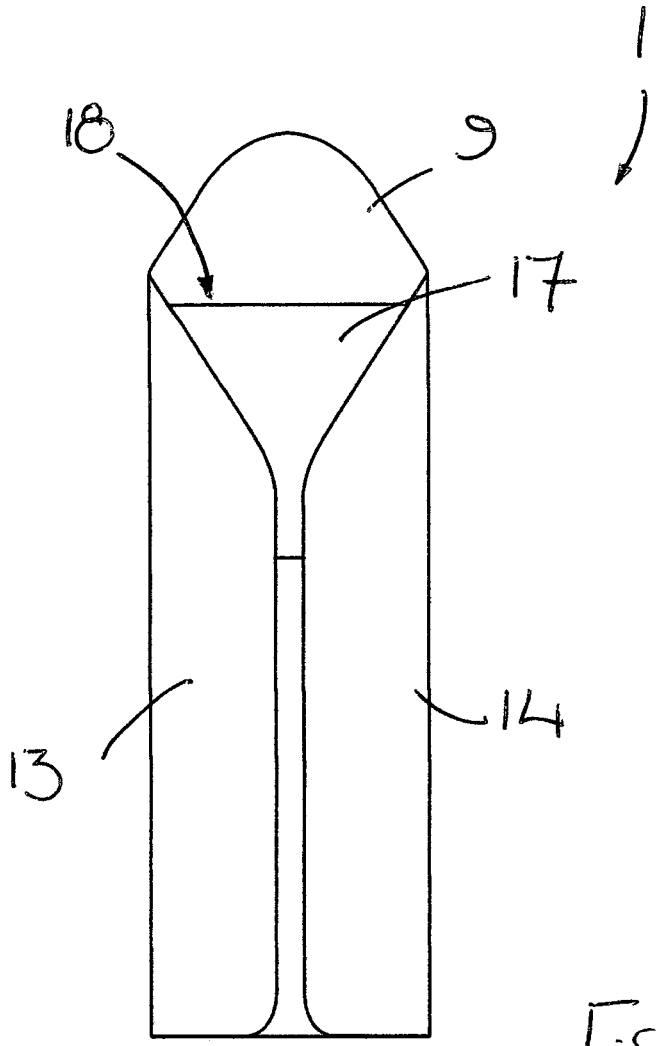
FIG. 3 is a plan view from above of the changing mat with the bottom panel/portion of the changing mat unfolded from the central panel/portion.
Figure 4:
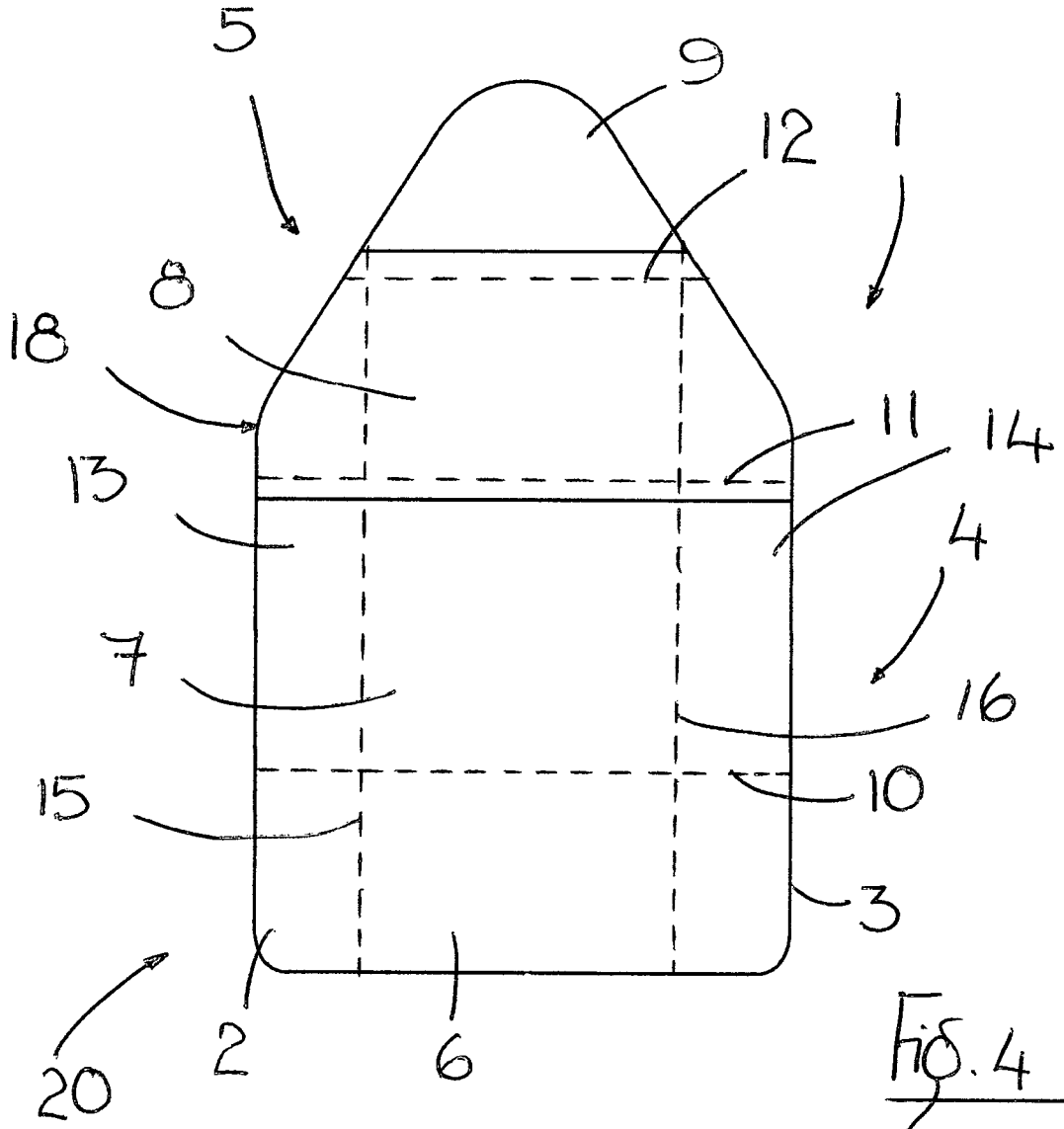
FIG. 4 is a plan view from above of the changing mat with the first and second side panels/portions unfolded so that the changing mat is in the fully open position and suitable for use with a non-mobile (young) infant with the fold lines and seams of the changing mat indicated by broken lines and with the baby restraint system concealed behind the headrest sheet.

As shown in the drawings, a non-rigid, soft, portable and foldable changing mat 1 of the invention for use by a user to change or dress infants and babies has a front face 2, a rear face 3 and is shaped to define a lower substantially square section 4 and an upper substantially triangular section 5 contiguous with the lower square section 4. The lower square section 4 is adapted to receive a baby's torso/legs during a nappy changing operation and is made up of a bottom panel 6 and a central panel 7 while the upper triangular section 5 is made up of a headrest panel 8 and a closing flap 9. The bottom panel 6 and the central panel 7 are foldable with respect to each other about a first transverse fold line 10 defined between the bottom panel 6 and the central panel 7 while the central panel 7 and the headrest panel 8 are foldable with respect to each other about a second transverse fold line 11. The closing flap 9 is foldable about a third transverse fold line 12 defined in the upper triangular section 5. The lower square section 4 is further provided with first and second side panels 13,14 defined by respective first and second vertical folds 15,16 either side of the lower square section 4.

The head rest panel 8 is provided with a liftable headrest cover sheet 17 secured to the upper triangular section 5 behind which is stored a built-in (user) knee operated or controllable restraint system 18 (when in a non-deployed position) for holding a baby in place on the changing mat 1.

As shall be explained more fully below, the changing mat 1 is movable by a user between a non-operational and portable closed/pouch position 19 (see FIG. 1), an intermediate open infant changing operating position 20 where the restraint system 18 is not required and therefore is concealed behind the liftable headrest cover sheet 17 i.e. not deployed (see FIG. 5) and a fully open baby restraining operating position 21 (see FIGS. 8 to 16) where the restraint system 18 is deployed to restrain wriggling and movement of a baby held in the restraint system 18.

The knee controlled or operated restraint system 18 is made up of a first or top cross-body arm-like strap 22 and a second or bottom cross-body arm-like strap 23 over which the top cross-body arm-like strap 22 overlaps. The top cross-body strap 22 has transverse torso band 24 extending laterally across the mat 1 at the intersection of the lower square section 4 and the upper triangular section 5 for covering a baby's torso and a strap-like knee controlled brace 25 contiguous with the torso band 24 but disposed along and over the first side panel 13 in the baby restraining operating position 21. More particularly, the strap-like brace 25 extends downwards from the torso band 24 at the outside edge of the first side panel 13 at right angles to the torso band 24. The brace 25 is provided with a kneepad 26 at its free end while the torso band 24 is provided with an attachment tab 27 secured to the upper triangular section 5 at a stitched seam 28 at the third transverse fold line 12. An armhole 29 for receiving a baby's arm is defined between the first cross-body strap 22 and the upper triangular section 5 adjacent the attachment tab 27. The cross-body strap 22 is reversibly or removably fixed to the changing mat 1 via openable and closeable fixings in the form of a first Velcro (Trade Mark) type patch 30 on the underside of the first cross-body strap 22 at an elbow portion 31 defined between the transverse torso band 24 and the contiguous knee brace 25 and a second Velcro (Trade Mark) type patch 32 on the underside of the kneepad 26.

The second cross-body strap 23 is similar in construction to the first cross-body strap 22 and is made up of a transverse torso band 33 also extending laterally across the mat 1 at the intersection of the lower square section 4 and the upper triangular section 5 for covering a baby's torso and a strap-like knee controllable brace 34 contiguous with the torso band 33 but disposed along and over the second side panel 14 in the baby restraining operating position 21. More particularly, the strap-like brace 25 extends downwards from the torso band 33 at the outside edge of the second side panel 14 at right angles to the torso band 33. The brace 34 is also provided with a kneepad 35 at its free end while the torso band 33 is provided with an attachment tab 36 secured to the upper triangular section 5 at a stitched seam 37 at the third transverse fold line 12. An armhole 38 for receiving a baby's arm is defined between the second cross-body strap 23 and the upper triangular section 5 adjacent the attachment tab 36. The cross-body strap 23 is removably fixed to the changing mat 1 via fixings in the form of a first Velcro (Trade Mark) type patch 39 on the underside of the second cross-body strap 23 at an elbow portion 40 defined between the transverse torso band 33 and the contiguous knee brace 34 and a second Velcro (Trade Mark) type patch 41 on the underside of the kneepad 35.

The Velcro (Trade Mark) patches 30,32,39,41 are reversibly or removably attachable to complementary Velcro (Trade Mark) patches 42,43,44,45 located on the upper surface of torso band 33 of the second cross-body strap 23, on the first side panel 13 at the bottom panel 6, on the second side panel 14 at the upper triangular section 5 and on the second side panel 14 at the bottom panel 6 respectively.

Figure 5:
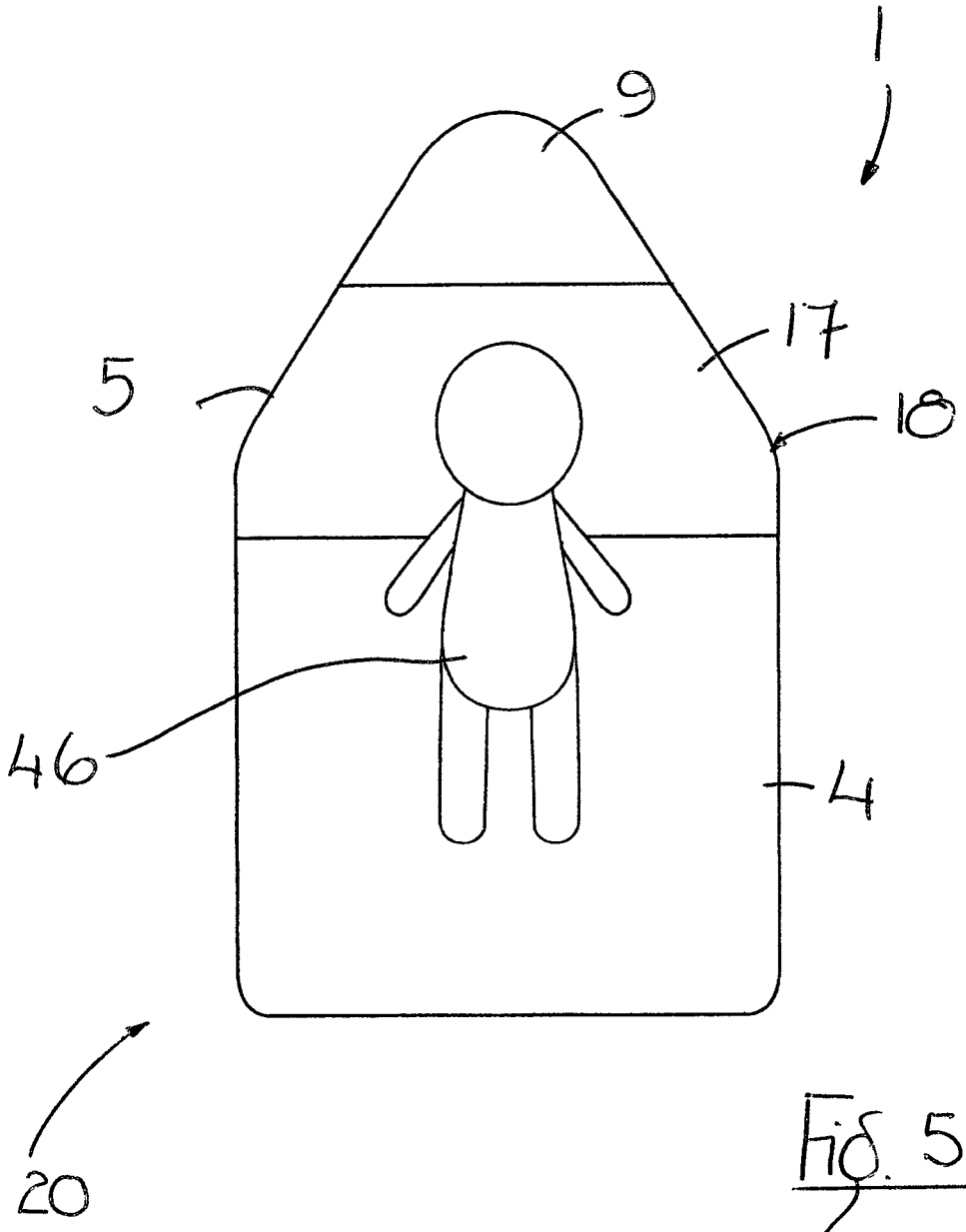
FIG. 5 is a plan view from above of the changing mat of FIG. 4 in use with an infant placed on the mat for performing a nappy changing operation with the head of the infant placed on the headrest cover sheet of the headrest panel.
Figure 6:
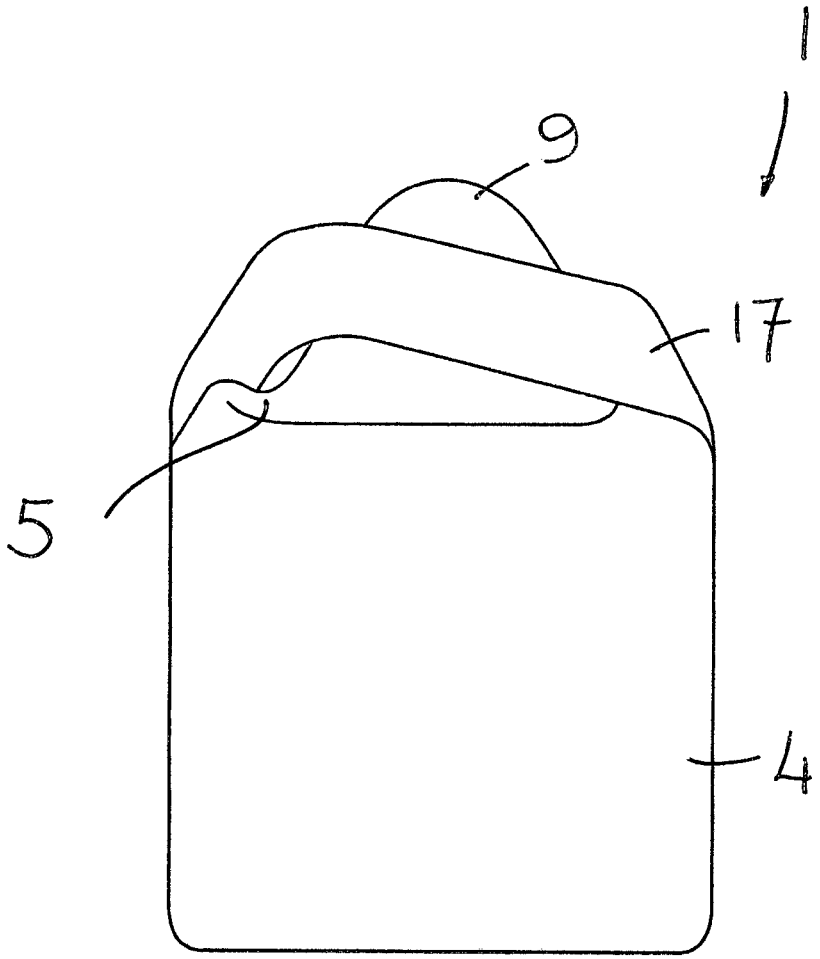
FIG. 6 is a plan view from above of the changing mat of FIG. 4 with the headrest cover sheet in the process of being moved behind the upper triangular section of the changing mat to expose the concealed and folded baby restraint system behind the headrest cover sheet at the intersection of the lower square section and the upper triangular section of the changing mat.
Figure 7:
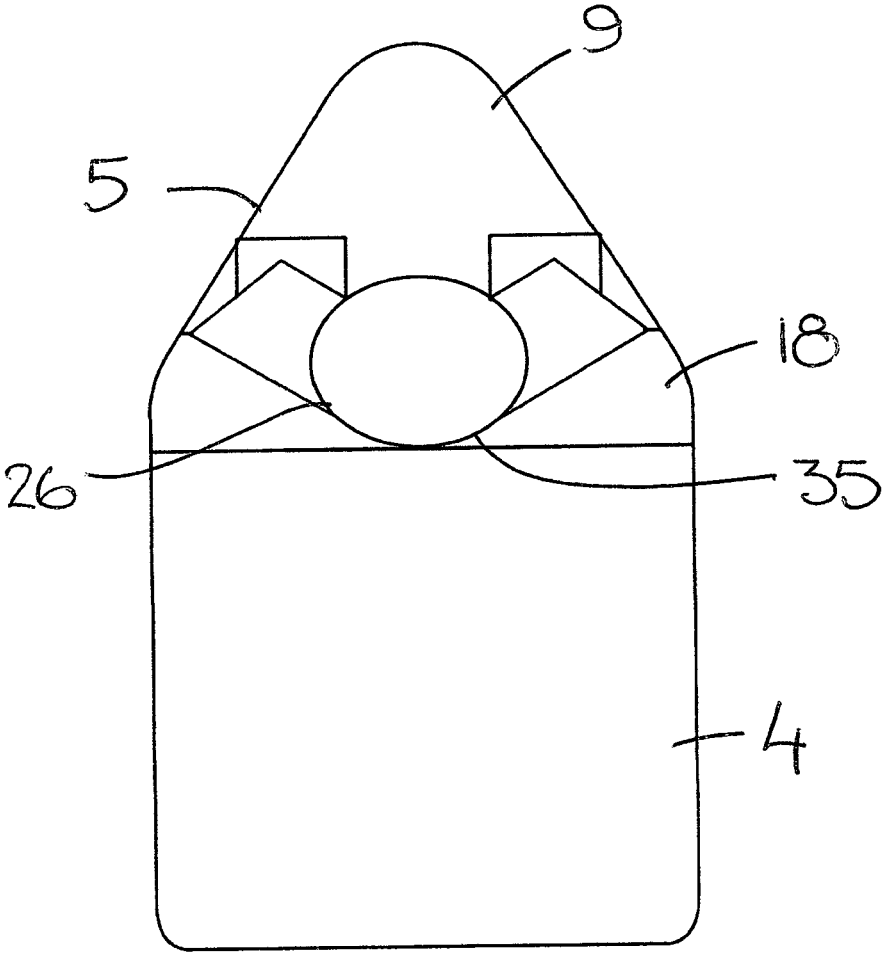
FIG. 7 is a plan view from above of the changing mat of FIG. 6 with the headrest cover sheet positioned behind the upper triangular section to fully expose the folded non-deployed knee controlled restraint system.
Figure 8:
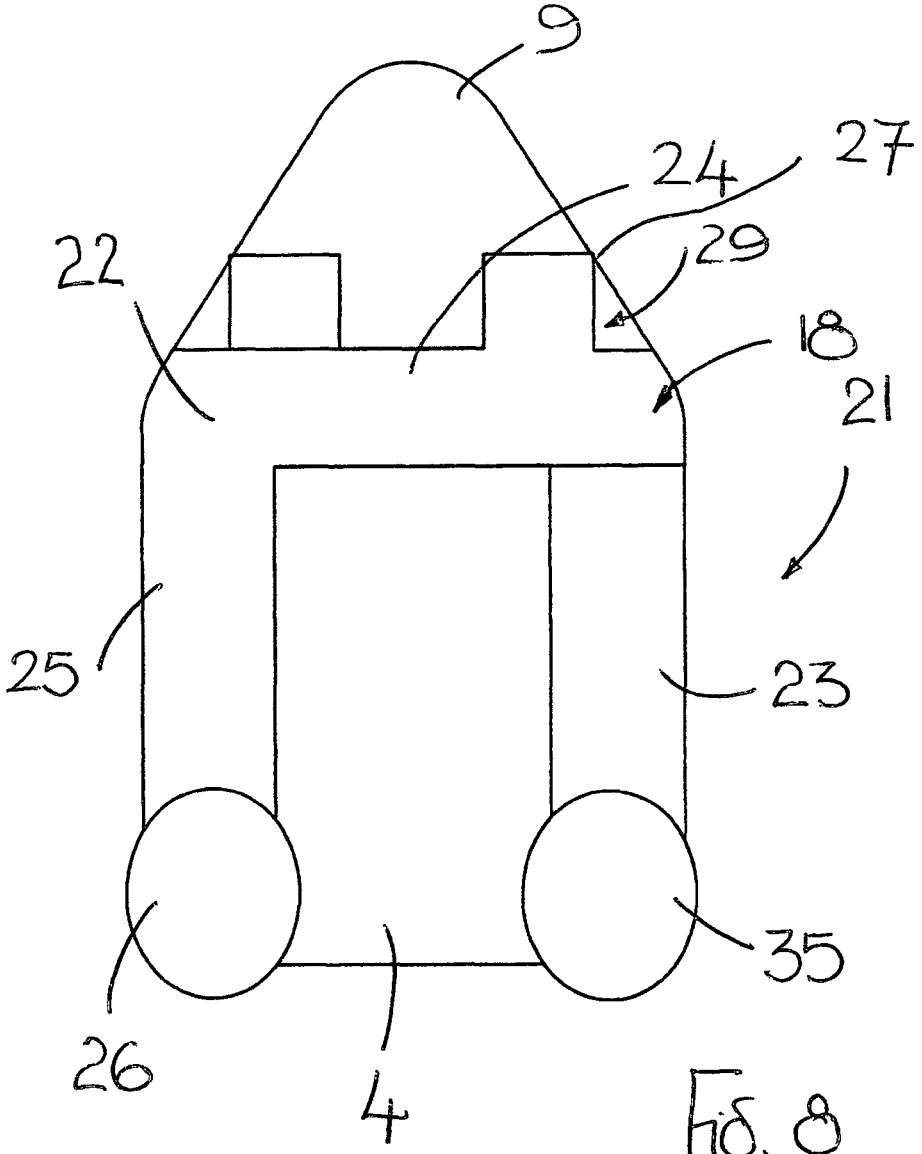
FIG. 8 is a plan view from above of the changing mat of FIG. 7 with the knee controlled restraint system in the unfolded deployed position with the two overlapping cross-over or cross-body straps of the restraint system reversibly or removably (i.e. openably and closeably) attached to the top panel and side panels of the changing mat and a kneeling pad defined on each side panel.
Figure 9:
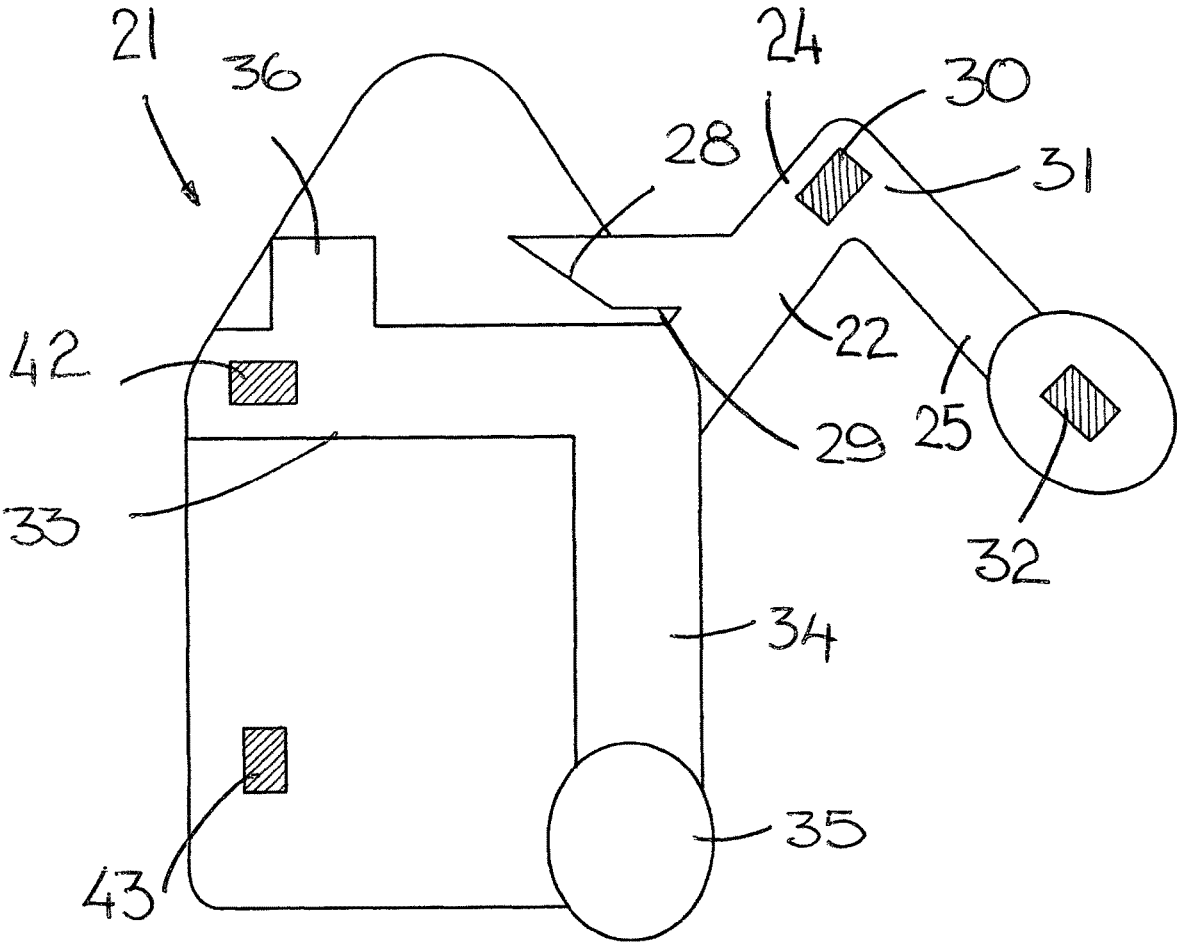
FIG. 9 is a plan view from above of the changing mat of FIG. 8 with the first or top cross-body strap partially reversibly detached from the changing mat.
Figure 10:
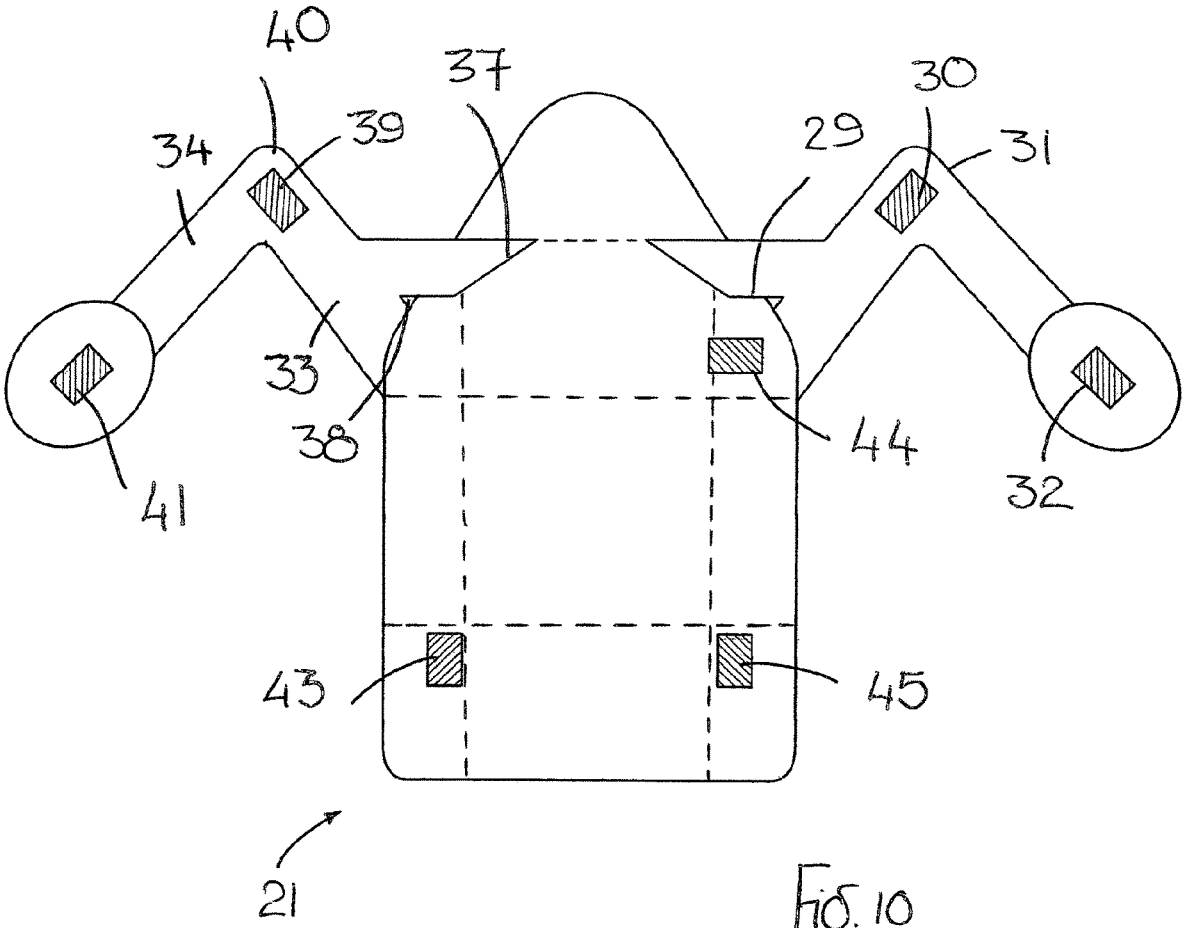
FIG. 10 is a plan view from above of the changing mat of FIG. 9 with the second or bottom cross-body strap partially reversibly detached from the changing mat.
Figure 11:
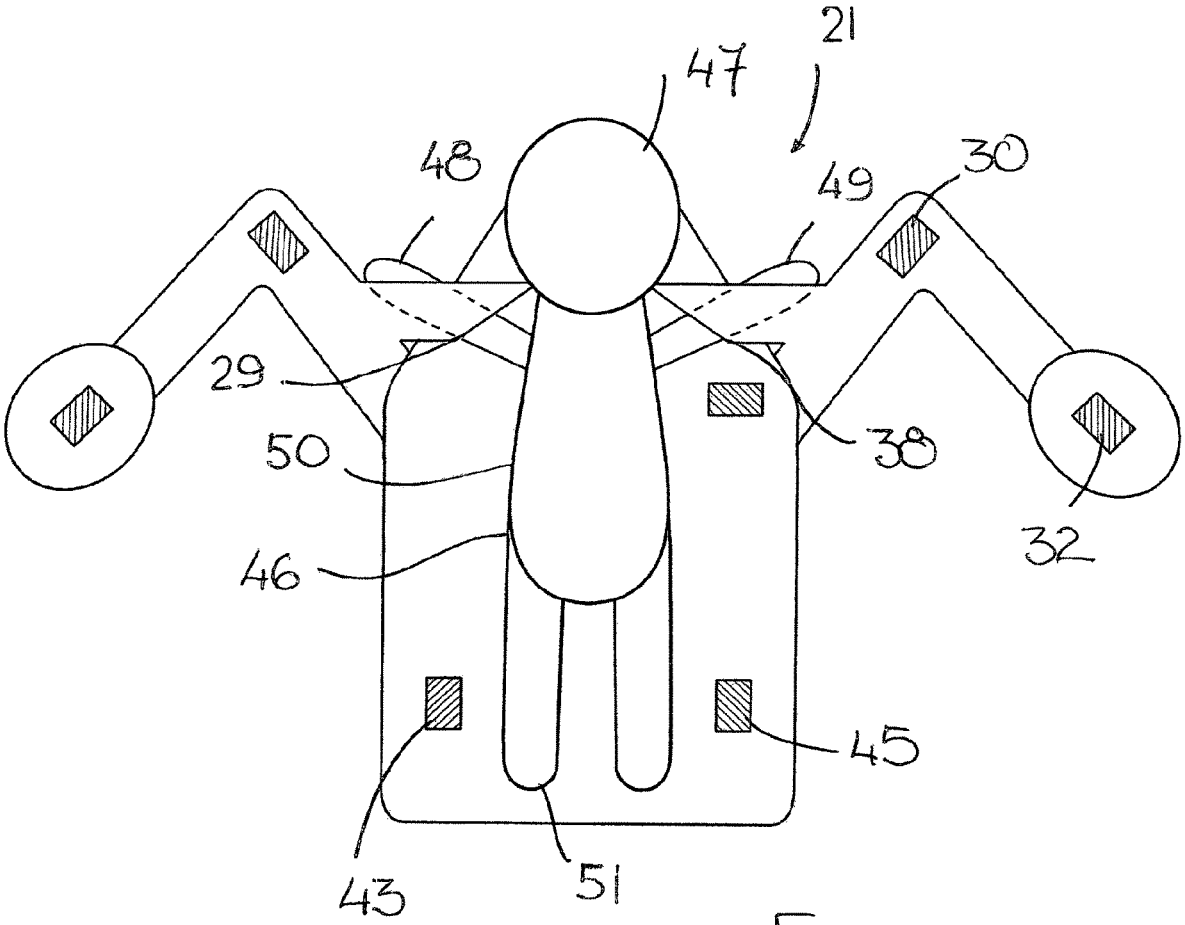
FIG. 11 is a plan view from above of the changing mat of FIG. 10 with a baby placed on the mat with the baby's arms placed in the armholes of the restraint system.

In use, the changing mat 1 can be employed in the intermediate infant operating position 20 shown in FIG. 5 in which deployment of the restraint system 18 is not required as the infant has not developed the capacity to move on the changing mat 1 so that restraint is unnecessary. As shown in the drawing, in this position, an infant 46 is simply placed on the changing mat 1 with the infant's head 47 on the headrest cover sheet 17 beneath which the non-deployed restraint system 18 is folded as shown in FIG. 7 to boost the headrest panel 8 for the infant 46. The infant's nappy can then be changed as required in conventional fashion.

Where the infant 46 is more developed (hereinafter referred to as a baby), the changing mat 1 is moved or transformed from the intermediate operating position 20 described above to the fully open baby restraining operating position 21 of FIGS. 8 to 16 by lifting the headrest cover sheet 17 over the upper triangular section 5 (see FIG. 6) to reveal the folded non-deployed restraint system 18 (see FIG. 7). The restraint system 18 is then simply unfolded and deployed into the baby restraining operating position 21 by arranging the first and second cross-body straps 22,23 as described above (see FIG. 8). In order to receive a baby 46, the first cross-body strap 22 is first opened by detaching the transverse torso band 24 and the knee brace 25 at the Velcro (Trade Mark) patches 30,32 (see FIG. 9) followed by opening the second cross-body strap 23 by detaching the transverse torso band 33 and the knee brace 35 at the Velcro (Trade Mark) patches 39,41 (see FIG. 10). The baby 46 is then simply placed on the changing mat 1 with its head 47 disposed towards the closing flap 9, its arms 48,49 inserted through the armholes 29,38, its torso 50 extending between the central panel 7 and the upper triangular section 5 and its legs 51 at the bottom panel 6 (see FIG. 11).

Figure 12:
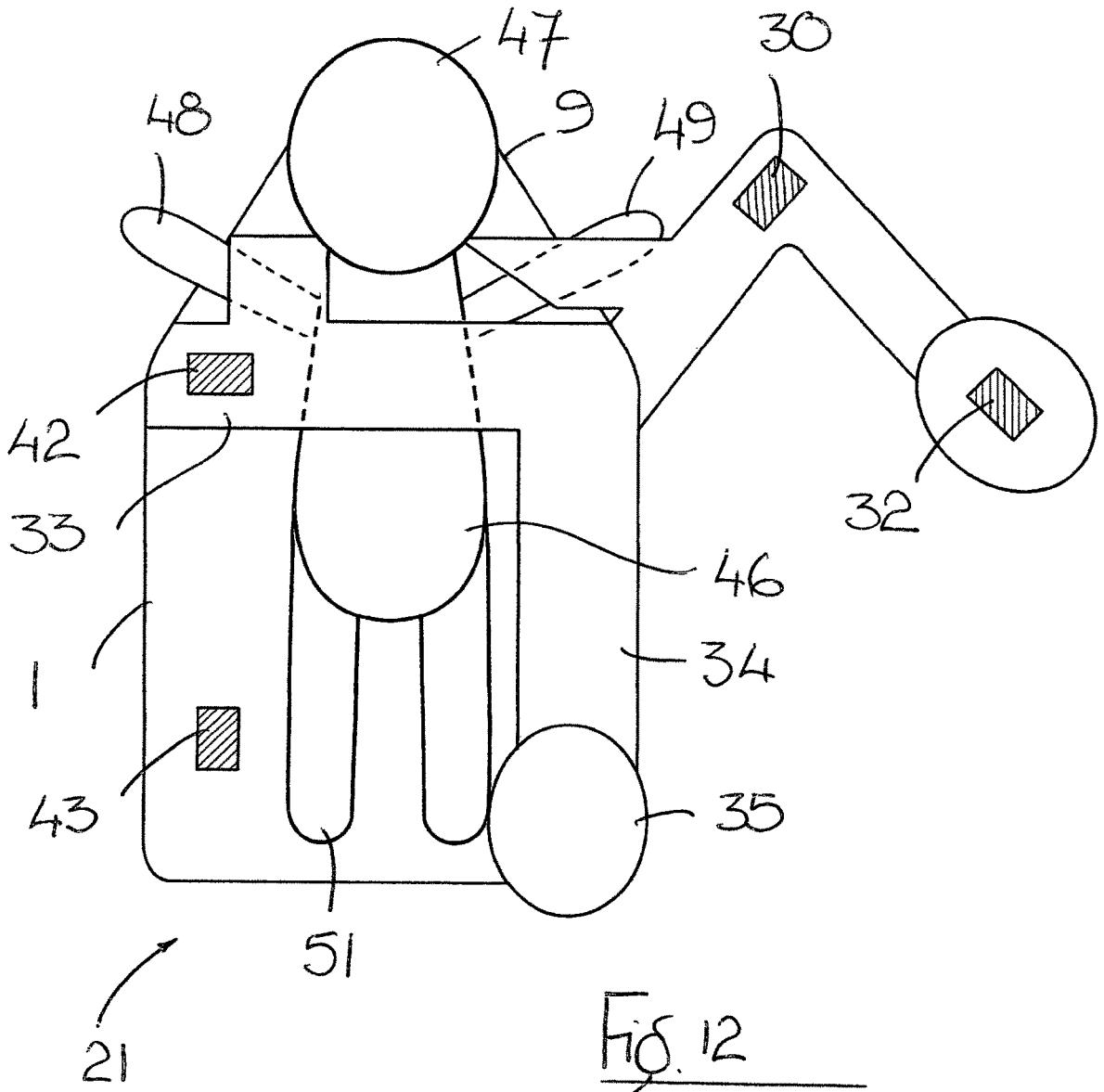
FIG. 12 a plan view from above of the changing mat of FIG. 11 with the second or bottom cross-body strap of the restraint system reversibly or removably secured over the baby.
Figure 13:
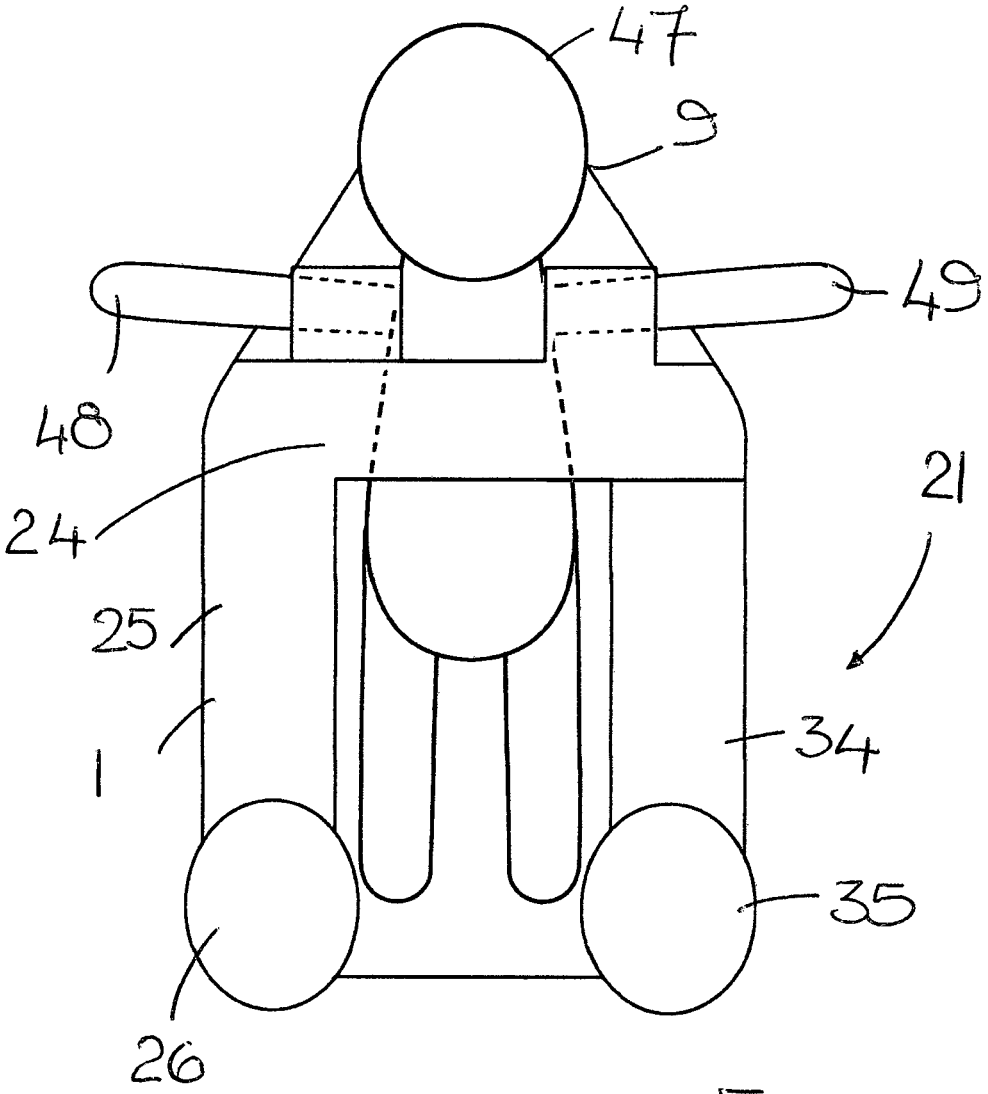
FIG. 13 a plan view from above of the changing mat of FIG. 12 with the first or top cross-body strap of the restraint system reversibly or removably secured over the baby to contain the baby.
Figure 14:
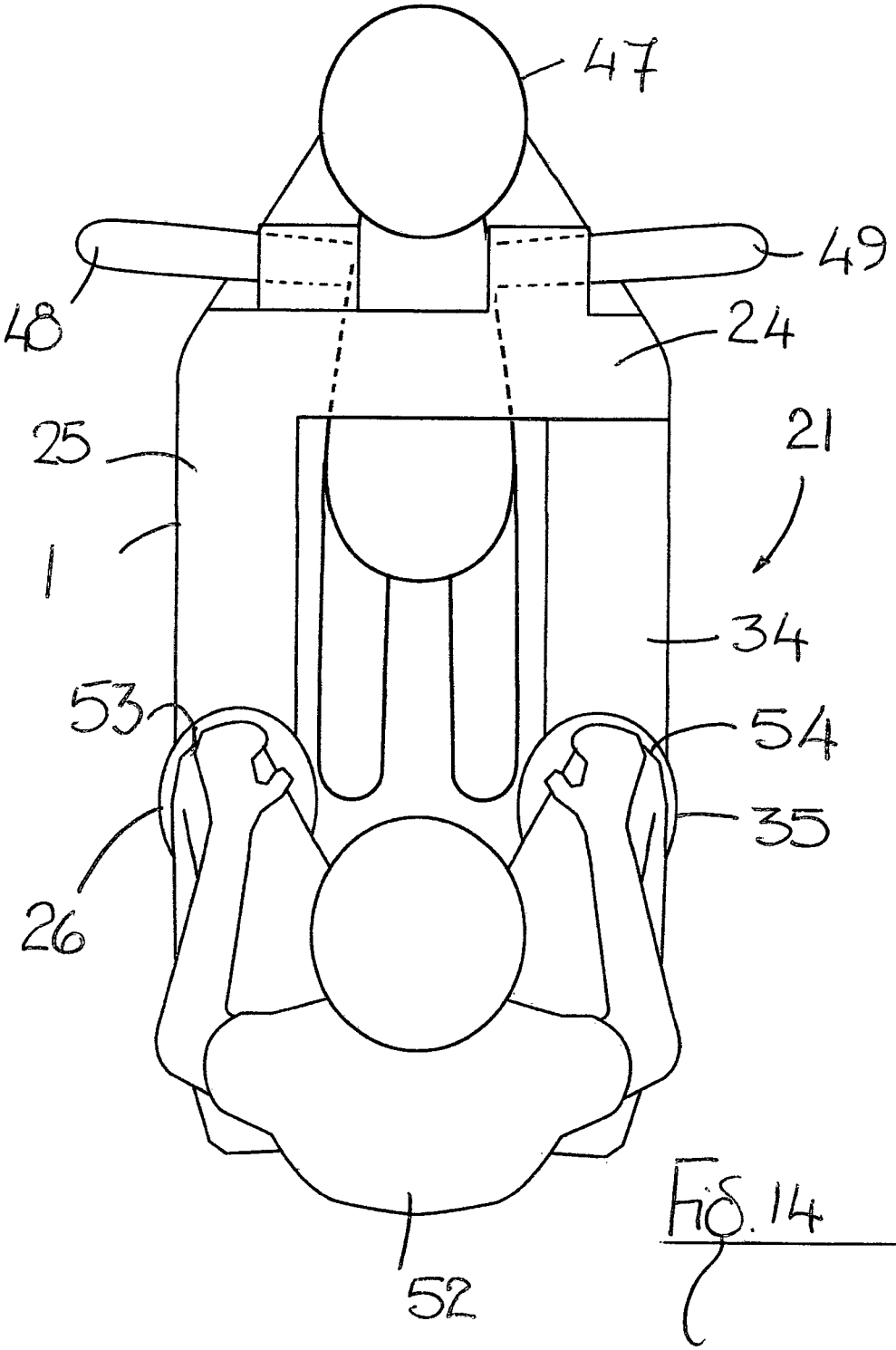
FIG. 14 is a plan view from above of the changing mat and baby of FIG. 13 with a carer kneeling on the kneepads of the restraint system to restrain and prevent movement of the baby via the cross-body straps connected to kneepads.
Figure 15:
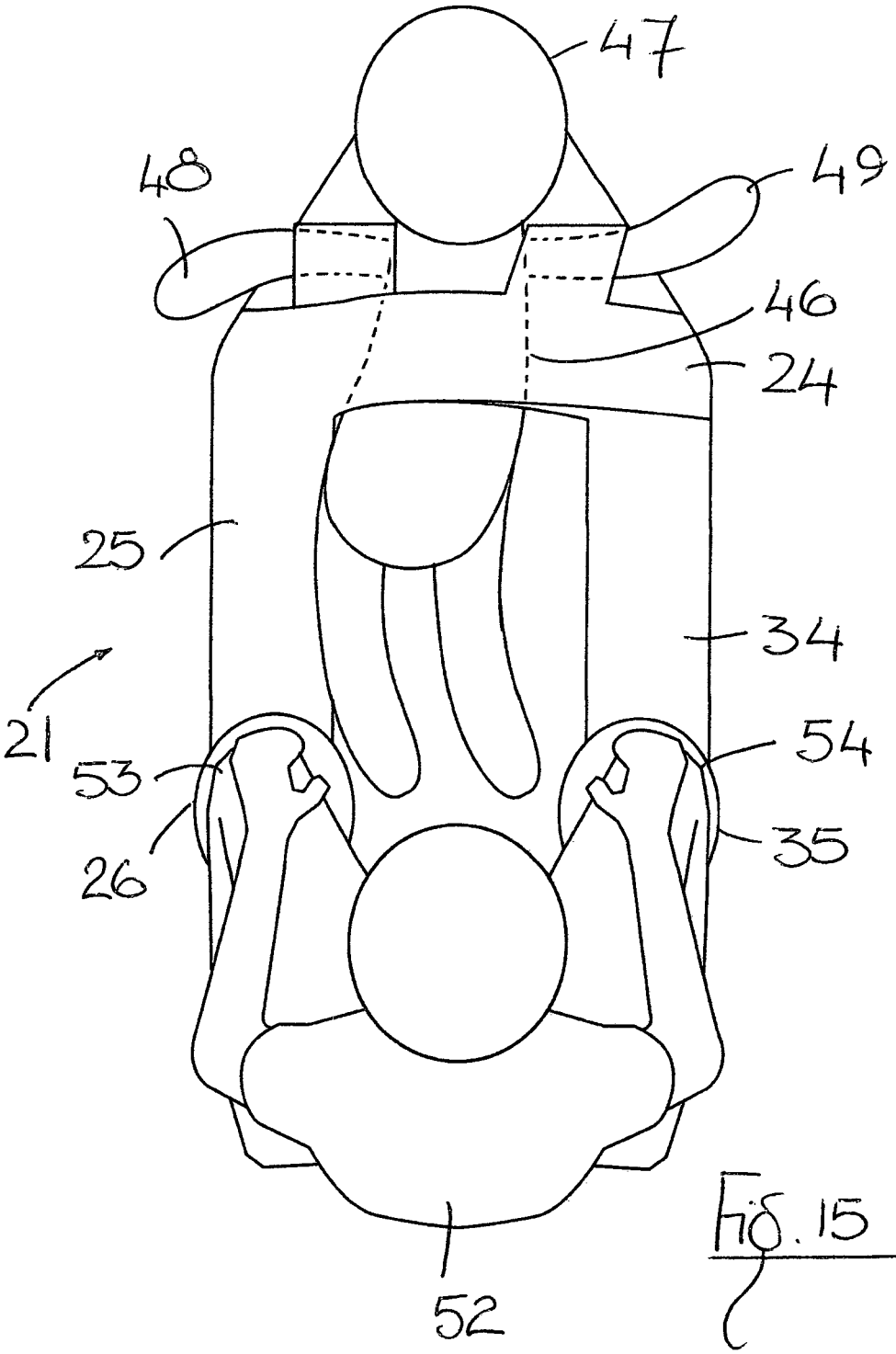
FIG. 15 is a plan view from above of the changing mat, baby and carer of FIG. 14 with movement or wriggling of the baby in a first direction being contained by the restraint system to allow for baby changing by the carer with both hands.
Figure 16:
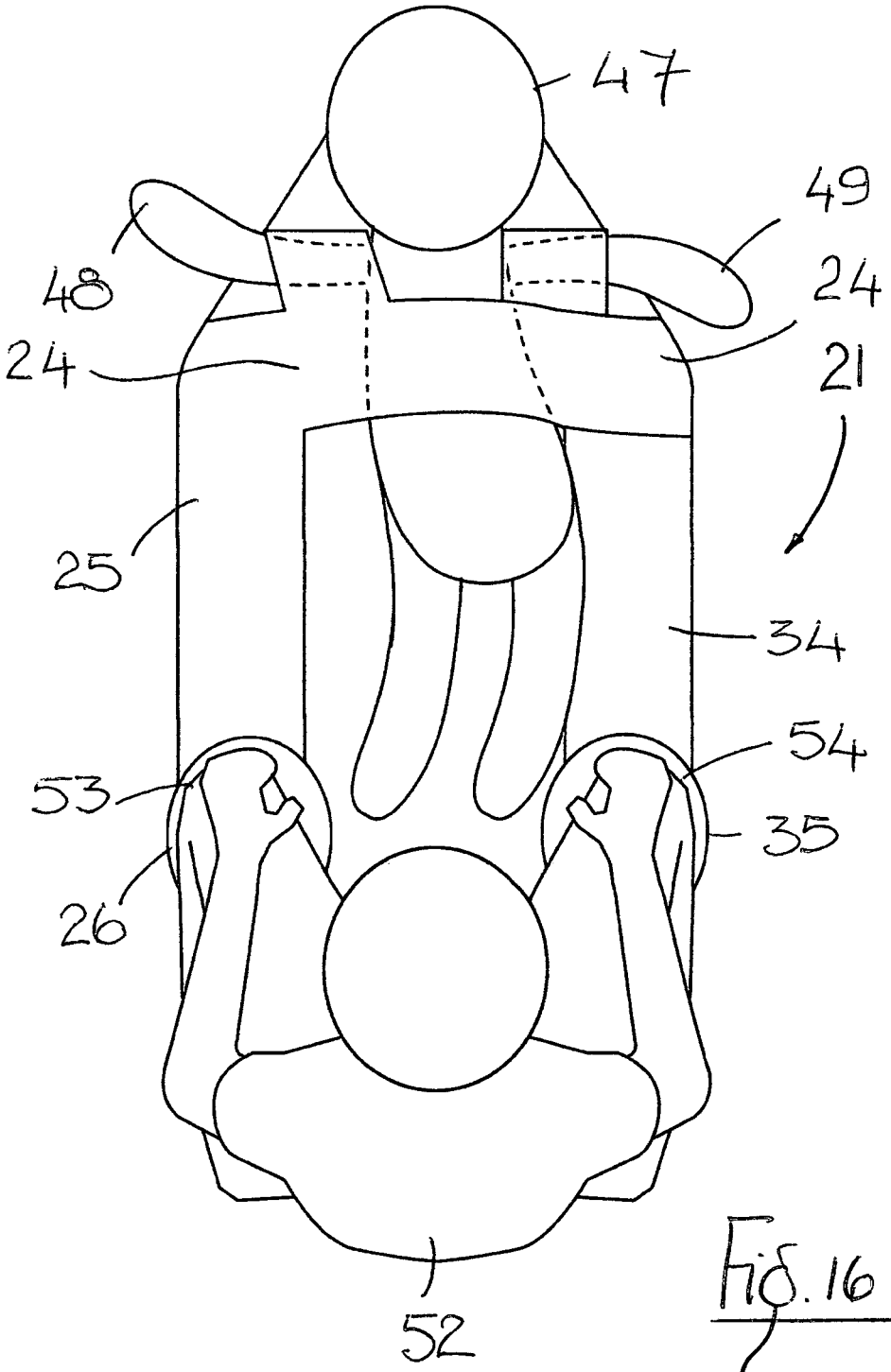
FIG. 16 is a plan view from above of the changing mat, baby and carer of FIG. 15 with movement or wriggling of the baby in a second direction being is contained by the restraint system to allow for baby changing by the carer with both hands.

The restraint system 18 is then closed over the baby 46 by reattaching the first and second cross-body straps 22,23 in reverse order to embrace the baby 46 in the restraint system 18 (see FIGS. 12 and 13). The baby 46 is therefore comfortably secured in the restraint system 18 on the changing mat 1. In order to perform a nappy changing operation, a carer 52 simply places his/her knees 53,54 on the kneepads 26,35 of the restraint system 18 to attend to the baby 46 (see FIG. 14). The downward force of the carer's 52 knees 53,54 on the kneepads 26,35 prevents movement or upwards lifting of the strap-like braces 25,34 to in turn prevent excessive upwards lifting or movement of the contiguous transverse torso bands 24,33 across the baby 46 thereby preventing the baby 46 from moving excessively to allow baby changing of the baby 46 with both hands whilst safely restraining the baby in a comfortable manner—the torso bands 24,33 by being effectively connected to the kneepads 26,35 counterbalance the baby's movement, so if he/she tries to roll to the left, the force on the right kneepad counteracts the movement and vice versa when trying to roll to the right (see FIGS. 15 and 16).

Following use, the changing mat 1 is returned to the portable closed pouch position 19 of FIG. 1 by first folding the changing mat 1 along the first and second vertical folds 15,16 and then folding the changing mat 1 about the first, second and third transverse fold lines 10,11,12 respectively. The changing mat 1 is held in place in the pouch position 19 by securing the closing flap 9 to the central panel 7 as shown in FIG. 1 e.g. with a strap or other closure device.

The changing mat 1 can be formed from any suitable material as required. If desired, the changing mat 1 can be shaped and formed so that the restraint system 18, and in particular the first and second cross-body straps 22,23, resemble embracing arms while the changing mat 1 can be imprinted with cartoon character images and the like. Where the changing mat 1 of the invention is employed as a fixed or stationary changing mat, the mat 1 can be formed from bulky, rigid or semi-rigid materials if desired e.g. foams and the like. The changing mat 1 can also be secured to backings made up of such bulky, rigid or semi-rigid materials if desired. Similarly, in an alternative embodiment of the invention, the changing mat 1 can be provided with table mountings for attaching the changing mat to changing tables and the like e.g. two loops either side of the changing mat 1 and an associated attachment strap.

As indicated above, the changing mat 1 can function as a changing mat 1 or a dressing mat if desired. For example, the changing/dressing mat 1 can be formed from a toweling material to serve both as a baby towel to assist in restraining, drying and dressing a baby as required following bathing.

The invention claimed is:

1. A baby changing mat comprising a restraint system for restraining movement of a baby, wherein the restraint system comprises a knee controllable restraint system, wherein the knee controllable restraint system comprises at least one strap reversibly secured to the mat, wherein the at least one strap comprises a transverse torso band configured to cover a torso of the baby and a knee controllable brace, wherein the knee-controllable restraint system is configured to restrain upwards lifting of the knee controllable brace to in turn restrain upward movement of the transverse torso band across the torso of the baby thereby preventing the baby from moving upon a downward force being applied to a force receiving portion of the knee controllable brace, wherein the knee-controllable brace comprises a strap-like brace, and wherein the knee controllable brace further comprises a top surface configured to receive the downward force from a knee of a carer, wherein the top surface is distal from the transverse torso band.

2. A baby changing mat as claimed in claim 1 wherein the at least one strap comprises a cross-body strap.

3. A baby changing mat as claimed in claim 2 wherein the knee controllable brace is contiguous with the torso band.

4. A baby changing mat as claimed in claim 3 wherein the knee controllable brace is at a substantially right angle to the torso band.

5. A baby changing mat as claimed in claim 1 wherein the knee controllable restraint system comprises a pair of cross-body straps.

6. A baby changing mat as claimed in claim 5 wherein the pair of cross-body straps comprises a pair of overlapping cross-body straps for embracing a baby.

7. A baby changing mat as claimed in claim 1 wherein the mat comprises a baby headrest.

8. A baby changing mat as claimed in claim 7 wherein the mat comprises a headrest cover sheet at the headrest.

9. A baby changing mat as claimed in claim 8 wherein the baby changing mat comprises a portable baby changing mat.

10. A baby changing mat as claimed in claim 9 wherein the portable baby changing mat is movable between a closed position and an open baby restraining operating position.

11. A baby changing mat as claimed in claim 10 wherein the baby changing mat is movable between the closed position and the open baby restraining operating position about a plurality of fold lines defined in the baby changing mat.

12. A baby changing mat as claimed in claim 11 wherein the baby changing mat is folded in the closed position.

13. A baby changing mat as claimed in claim 10 wherein the baby changing mat comprises a pouch in the closed position.

14. A baby changing mat as claimed in of claim 10 wherein the baby changing mat is movable between the closed position and an intermediate open infant changing operating position in which the restraint system is concealed on the mat.

15. A baby changing mat as claimed in claim 14 wherein the restraint system is concealed by the headrest cover sheet in the intermediate open infant position.

16. A baby changing mat as claimed in claim 15 wherein the baby changing mat is movable between the closed position and the intermediate open infant changing operating position about the plurality of fold lines defined in the mat.

17. A baby changing mat as claimed in claim 1 wherein the mat further comprises a plurality of table mountings for attaching the changing mat to a changing table.

18. A baby changing mat as claimed in claim 1 wherein the mat comprises a lower substantially square section and an upper substantially triangular section.

19. A baby changing mat as claimed in claim 18 wherein the upper substantially triangular section comprises a closing flap.

20. A baby changing mat as claimed in claim 18 wherein the lower substantially square section comprises first and second side panels defined by respective first and second vertical folds either side of the lower square section.

21. A baby changing mat as claimed in claim 1 wherein the changing mat comprises a stationary changing mat.

22. A baby changing mat as claimed in claim 1 wherein the changing mat comprises a soft non-rigid changing mat.

23. A baby changing mat as claimed in claim 22 wherein the changing mat comprises a towel.

24. A baby changing mat comprising a restraint system for restraining movement of a baby, wherein the restraint system comprises a knee controllable restraint system, wherein the knee controllable restraint system comprises at least one strap reversibly secured to the mat, wherein the at least one strap comprises a transverse torso band configured to cover a torso of the baby and a knee controllable brace, wherein the mat comprises a baby headrest, wherein the mat comprises a headrest cover sheet at the baby headrest, wherein the baby changing mat comprises a portable baby changing mat, wherein the portable baby changing mat is movable between a closed position and an open baby restraining operating position, wherein the baby changing mat is movable between the closed position and an intermediate open infant changing operating position in which the restraint system is concealed on the mat, wherein the at least one strap of the restraint system is concealed by the headrest cover sheet in the intermediate open infant position, wherein the knee controllable brace comprises a strap-like brace, and wherein the knee controllable brace further comprises a top surface configured to receive a knee of a carer, wherein a downward force on the top surface is configured to apply the downward force to a force receiving portion of the knee controllable brace to restrain upward lifting of the strap-like brace.

* * * * *